US011027307B2

(12) United States Patent
Domenighi et al.

(10) Patent No.: US 11,027,307 B2
(45) Date of Patent: Jun. 8, 2021

(54) NOZZLE TIP AND METHOD FOR DISPENSING ONTO A PANEL EDGE

(71) Applicant: 3M INNOVATIVE PROPERTIES COMPANY, St. Paul, MN (US)

(72) Inventors: Alvaro S. Domenighi, St. Paul, MN (US); Kim L. Gustafson, Lake Stevens, WA (US); Patrick G. Zimmerman, Mendota Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 23 days.

(21) Appl. No.: 16/735,311

(22) Filed: Jan. 6, 2020

(65) Prior Publication Data

US 2020/0139395 A1 May 7, 2020

Related U.S. Application Data

(63) Continuation-in-part of application No. 15/548,617, filed as application No. PCT/US2016/021464 on Mar. 9, 2016, now abandoned.

(60) Provisional application No. 62/132,823, filed on Mar. 13, 2015.

(51) Int. Cl.

| | |
|---|---|
| ***B05D 5/10*** | (2006.01) |
| ***B05C 1/00*** | (2006.01) |
| ***B05C 17/005*** | (2006.01) |
| ***B05C 5/02*** | (2006.01) |

(52) U.S. Cl.

CPC ..... *B05C 1/006* (2013.01); *B05C 5/0204* (2013.01); *B05C 17/00516* (2013.01); *B05D 5/10* (2013.01)

(58) Field of Classification Search

None

See application file for complete search history.

(56) References Cited

U.S. PATENT DOCUMENTS

| | | | |
|---|---|---|---|
| 796,246 | A | 8/1905 | Printz |
| 3,807,351 | A | 4/1974 | Tuberman |
| 4,378,170 | A | 3/1983 | Orr |
| 5,250,145 | A | 10/1993 | Despins |

(Continued)

FOREIGN PATENT DOCUMENTS

| | | |
|---|---|---|
| CA | 2 254 295 | 5/2000 |
| DE | 20319881 | 4/2004 |

(Continued)

OTHER PUBLICATIONS

International Search Report for PCT International Application No. PCT/US2016/021464, dated Jun. 10, 2016, 6pgs.

*Primary Examiner* — Charles Capozzi

(74) *Attorney, Agent, or Firm* — Philip P. Soo

(57) ABSTRACT

Nozzles are provided, for applying setting resins onto the edge of a panel, in some embodiments the cut edge of a panel such as a honeycomb panel. The nozzle comprises a connector portion and an application head, wherein the application head comprises: a) a supporting wall, and b) a curved finish wall joining the supporting wall along an edge at an angle of greater than 92 degrees and less than 120 degrees. In some embodiments, the curved finish wall has a curve radius which remains between 1.0 and 7.0 cm throughout the length of the curved finish wall. In some embodiments, the curved finish wall has a trailing edge profile which is smoothly curved and a leading edge profile which is scalloped. In addition, methods of applying a setting resin onto the edge of a panel are presented.

14 Claims, 4 Drawing Sheets

(56) References Cited

U.S. PATENT DOCUMENTS

| | | | |
|---|---|---|---|
| 5,471,704 | A | 12/1995 | Woolley |
| 6,276,858 | B1 | 8/2001 | Kennedy |
| 2009/0294489 | A1 | 12/2009 | Keohan |
| 2011/0082432 | A1 | 4/2011 | Fontana |
| 2012/0091172 | A1 | 4/2012 | Maier |
| 2015/0017326 | A1 | 1/2015 | Solana |

FOREIGN PATENT DOCUMENTS

| | | |
|---|---|---|
| EP | 0250129 | 12/1987 |
| EP | 2896463 | 7/2015 |
| GB | 1026463 | 4/1966 |
| GB | 2352989 | 2/2001 |
| WO | WO 1984-04262 | 11/1984 |
| WO | WO 2007-028857 | 3/2007 |
| WO | WO 2009-009840 | 1/2009 |
| WO | WO 2016-148937 | 9/2016 |
| WO | WO 2016-148938 | 9/2016 |

NOZZLE TIP AND METHOD FOR DISPENSING ONTO A PANEL EDGE

CROSS REFERENCE TO RELATED APPLICATIONS

This application is a continuation application of pending prior application Ser. No. 15/548,617, filed Aug. 3, 2017, which is a national stage filing under 35 U.S.C. 371 of PCT/US2016/021464, filed Mar. 9, 2016, which claims the benefit of US Provisional Patent Application No. 62/132,823, filed Mar. 13, 2015, the disclosures of which are incorporated by reference in their entirety herein.

FIELD OF THE DISCLOSURE

This disclosure relates to nozzles for applying setting resins onto the edge of a panel and methods of applying setting resins onto the edge of a panel.

BACKGROUND OF THE DISCLOSURE

The following references may be relevant to the general field of technology of the present disclosure: U.S. Pat. Nos. 5,250,145, 6,276,858, US 2009/0294489 A1, and US2012/0091172 A1.

SUMMARY OF THE DISCLOSURE

Briefly, the present disclosure provides nozzles for applying setting resins onto the edge of a panel. The nozzle comprises a connector portion and an application head, wherein the connector portion is adapted to receive setting resin from a resin dispensing device and deliver the setting resin to the application head. The application head comprises: a) a supporting wall, and b) a curved finish wall joining the supporting wall along an edge at an angle of greater than 92 degrees and less than 120 degrees. The connector portion is adapted to deliver the setting resin to the application head in the interior of the angle formed between the supporting wall and the curved finishing wall. In some embodiments, the nozzle comprises a single supporting wall. In some embodiments, the nozzle comprises no component which makes contact with the panel other than the supporting wall and the curved finish wall during application of a setting resin onto the edge of a panel. In some embodiments, the curved finish wall has a curve radius which remains between 1.0 and 7.0 cm throughout the length of the curved finish wall. In some embodiments, the curved finish wall has a curve radius which remains between 1.0 and 7.0 cm throughout the first 1.6 cm of the curved finish wall, i.e., the 1.6 cm of the curved finish wall closest to supporting wall. In some embodiments, the curved finish wall has a curve radius which remains between 1.5 and 5.0 cm throughout the first 1.6 cm of the curved finish wall. In some embodiments, the curved finish wall has a curve radius which is longer closer to the joining between the curved finish wall and the supporting wall and shorter farther from the joining between the curved finish wall and the supporting wall. In some embodiments, the curved finish wall has a trailing edge profile which is smoothly curved and a leading edge profile which is scalloped. In some embodiments, the nozzle is a one-piece, integrally formed article. In some embodiments, the nozzle is optically translucent or transparent.

In another aspect, the present disclosure provides methods of applying a setting resin onto the edge of a panel, comprising the steps of: a) bringing the connector portion of a nozzle according to the present disclosure into connection with an output of a resin dispensing device; b) bringing the application head of the nozzle into contact with the edge of a panel; and c) dispensing the setting resin through the nozzle to the edge of the panel while the nozzle is moved in a lateral direction relative to the panel so as to apply resin to the panel edge. In some embodiments, the step of bringing the application head of the nozzle into contact with the edge of a panel comprises positioning the supporting wall of the nozzle plane parallel to and in contact with a top surface layer of the panel. In some embodiments, the step of bringing the application head of the nozzle into contact with the edge of a panel comprises positioning the nozzle such that the angle formed between the supporting wall and the finish wall rides on an outer edge of a top surface layer of the panel. In some embodiments, the panel is a honeycomb panel. In some embodiments, the setting resin is an adhesive. In some embodiments, the setting resin is a low density void filler.

DETAILED DESCRIPTION

This disclosure relates to nozzles for applying setting resins onto the edge of a panel or a cut edge of a panel and methods of applying setting resins onto the edge of a panel or a cut edge of a panel. In some embodiments, interior layers of the panel are undercut relative to the surface layers.

Any suitable panels may be used in the practice of the present disclosure. Typically, the panel comprises a top surface layer, at least one core layer, and a bottom surface layer. In some embodiments, the panel comprises a core material which presents voids or ragged or uneven surfaces when cut. In some embodiments, the panel is a honeycomb panel comprising a core layer of honeycomb support material. The honeycomb support material may be of any suitable geometry or material, including standard honeycomb and overexpanded honeycomb. Suitable materials may include metal or alloys, paper or card, plastic resins, fiber, or combinations thereof such as fiberglass or NOMEX® aramid resin-treated paper. In some embodiments, the panel is a foam core panel comprising a core comprising one or more layers of foam material. The surface layers may be single layers or may be comprised of two or more plies. The surface layers may be of any suitable material, which may include one or more of aluminum or other metals or alloys, plastic resins, such as phenolic resin, optionally incorporating glass fibers, aramid fabrics such as KEVLAR®, paper, resin, or veneer.

Figure 4:
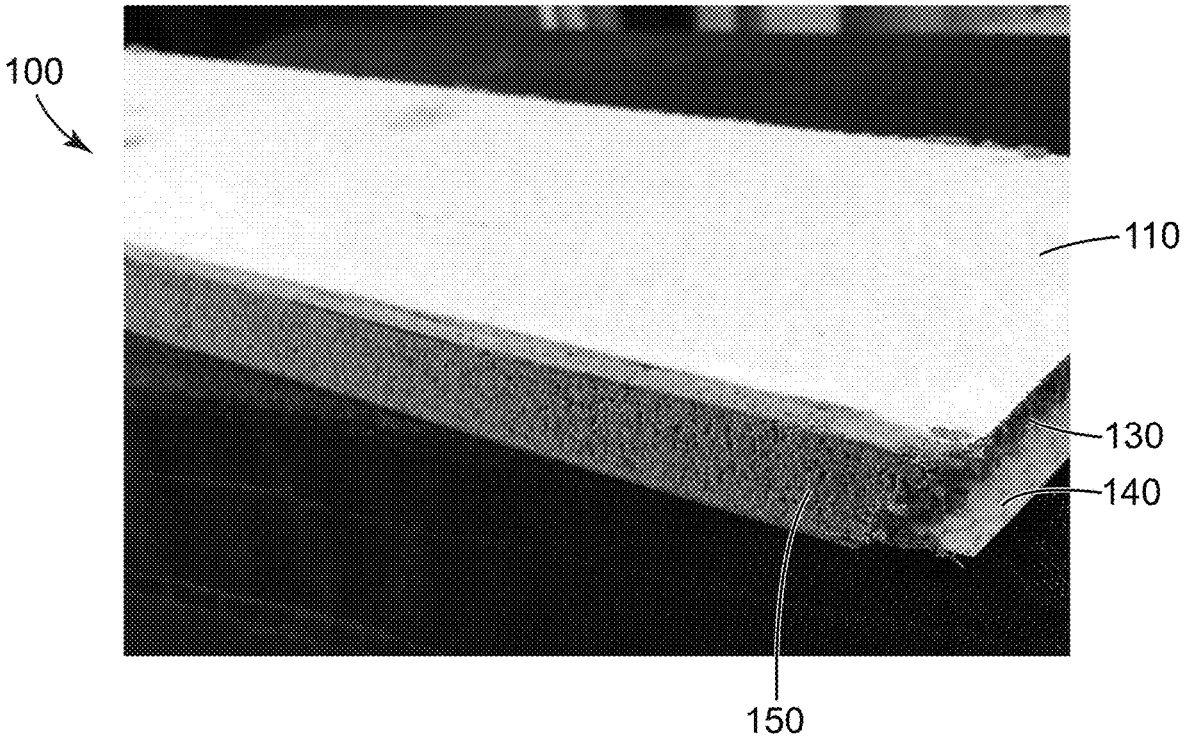
FIG. 4 is a photograph of a cut honeycomb panel bearing low density void filler on one cut edge which was applied from a nozzle according to the present disclosure, by a method according to the present disclosure.

FIG. 4 is a photograph of a honeycomb core panel 100 comprising top surface layer 110, bottom surface layer 140 and honeycomb core 130. A setting resin, in this case a low density void filling resin, has been applied to one edge of panel 100 using a nozzle and method of the present disclosure. The resin was allowed to cure in place to form edge fill 150.

Any suitable setting resins may be used in the practice of the present disclosure. Suitable materials may include adhesives, including one-part or two-part adhesives, and void filler materials, including low density void fillers.

Figure 1A:
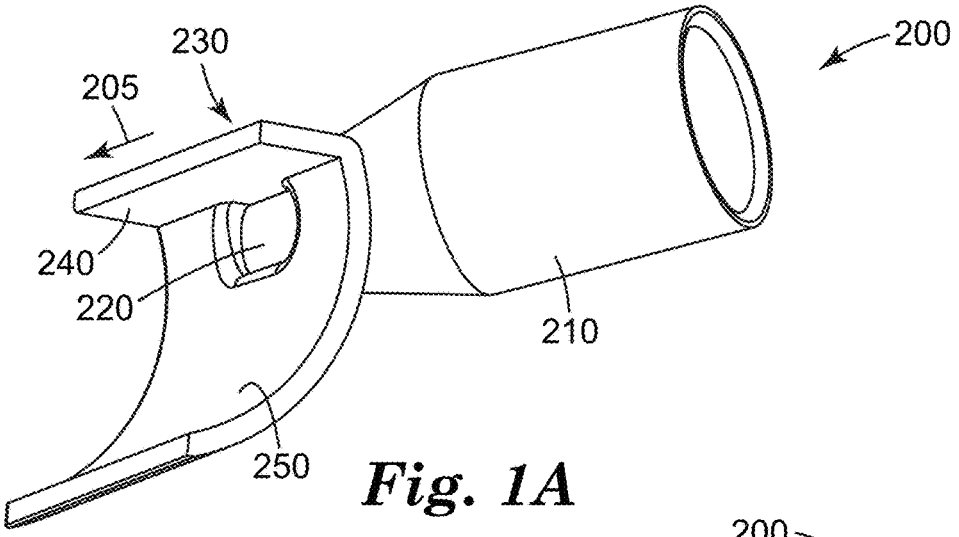
FIGS. 1A, 1B and 1C are views of a first embodiment of a nozzle according to the present disclosure.
Figure 1B:
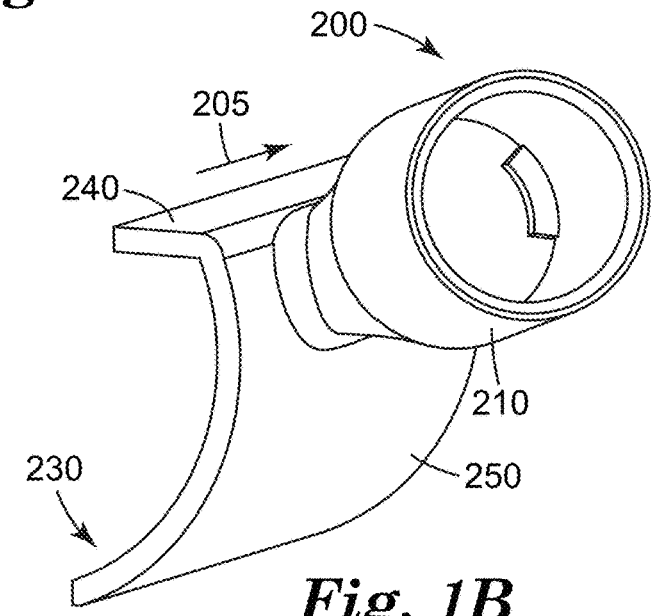
Figure 1C:
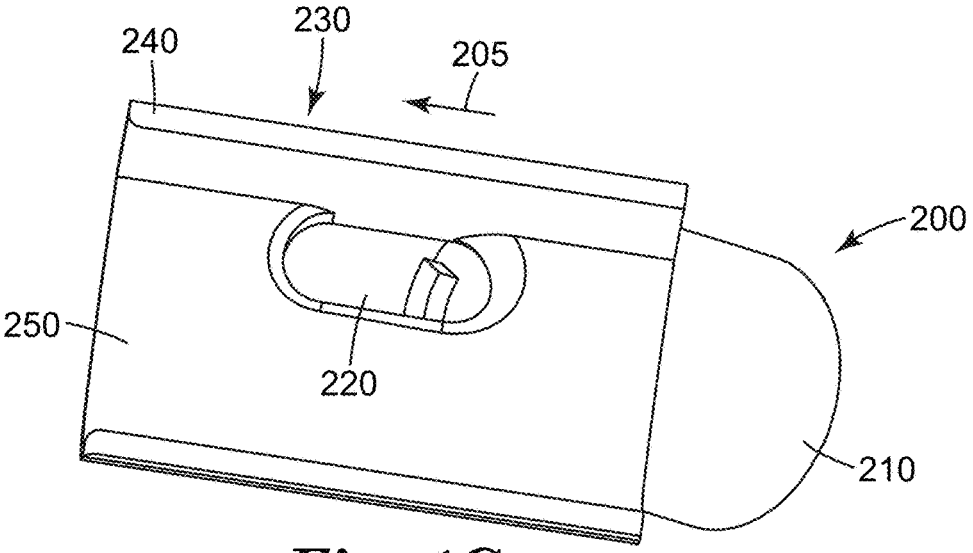
Figure 2A:
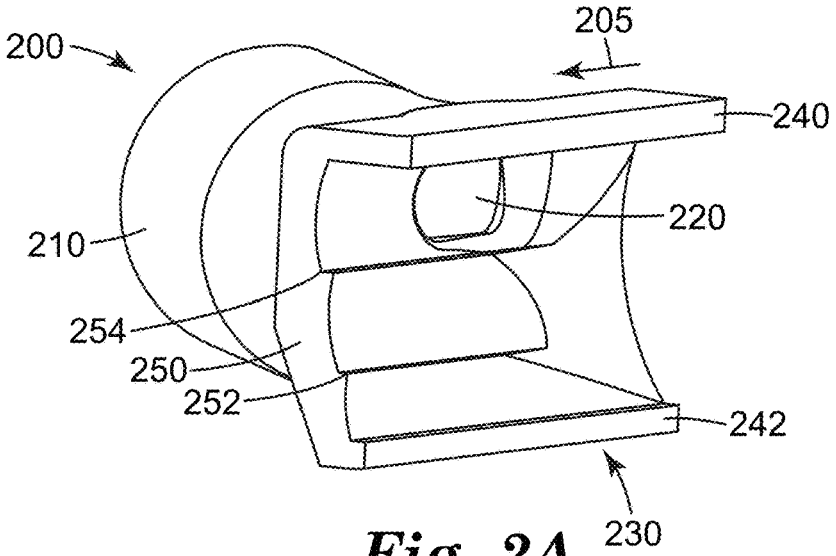
FIGS. 2A, 2B and 2C are views of a second embodiment of a nozzle according to the present disclosure.
Figure 2B:
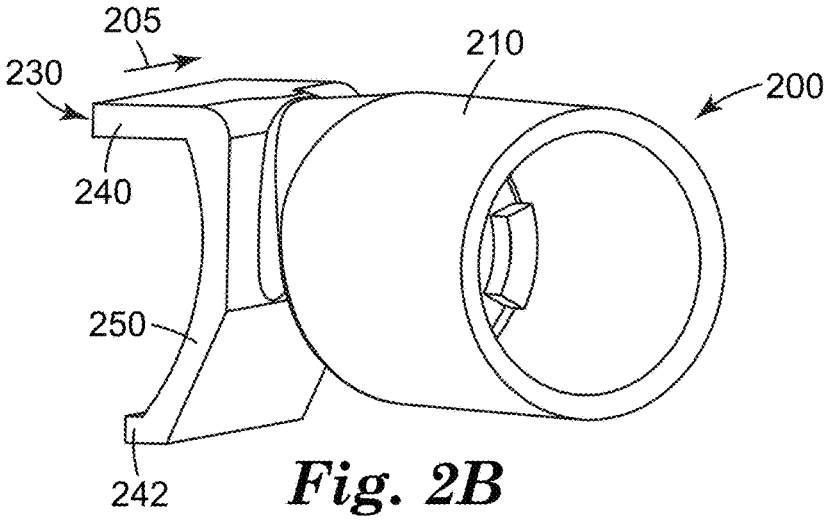
Figure 2C:
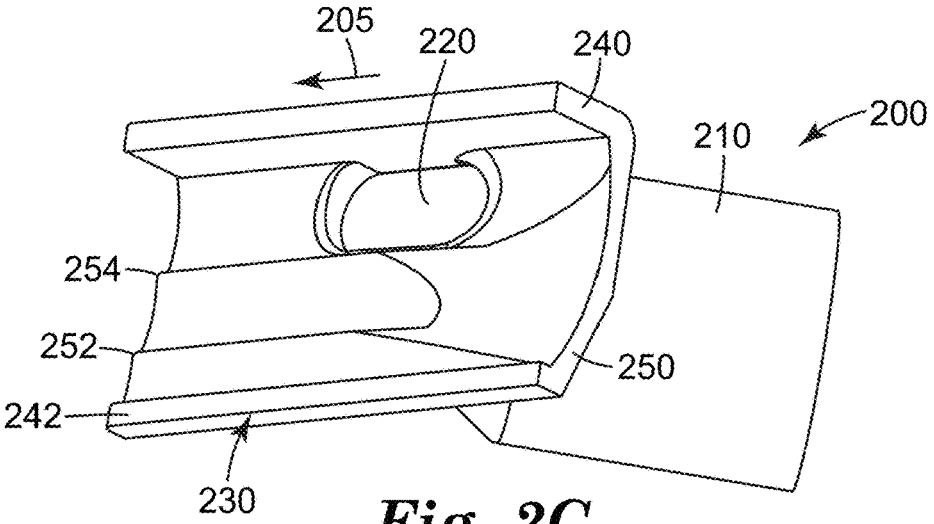
Figure 3A:
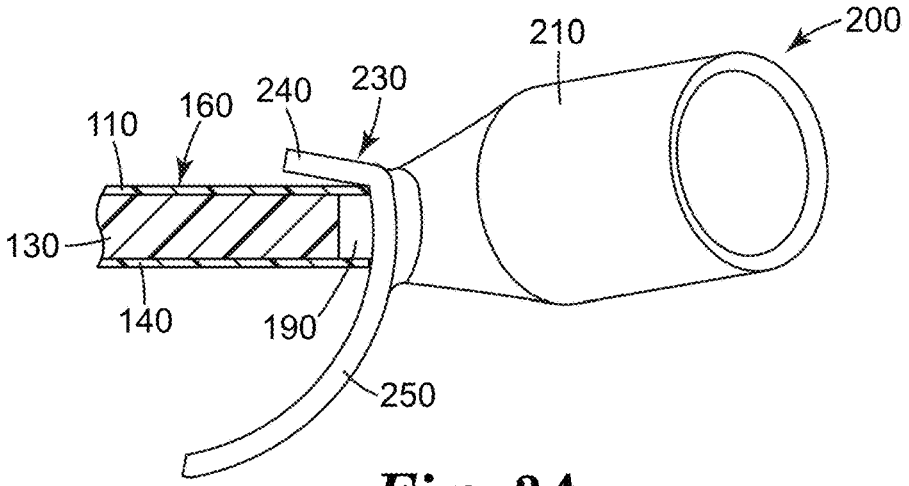
FIGS. 3A, 3B, and 3C are cross sections of a first embodiment of a nozzle according to the present disclosure positioned for use with three different sizes of cut panels.
Figure 3B:
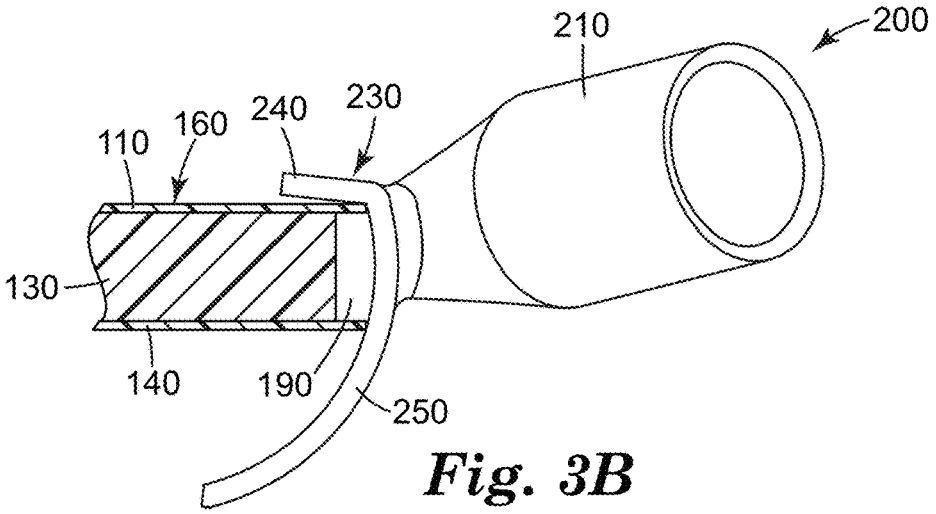
Figure 3C:
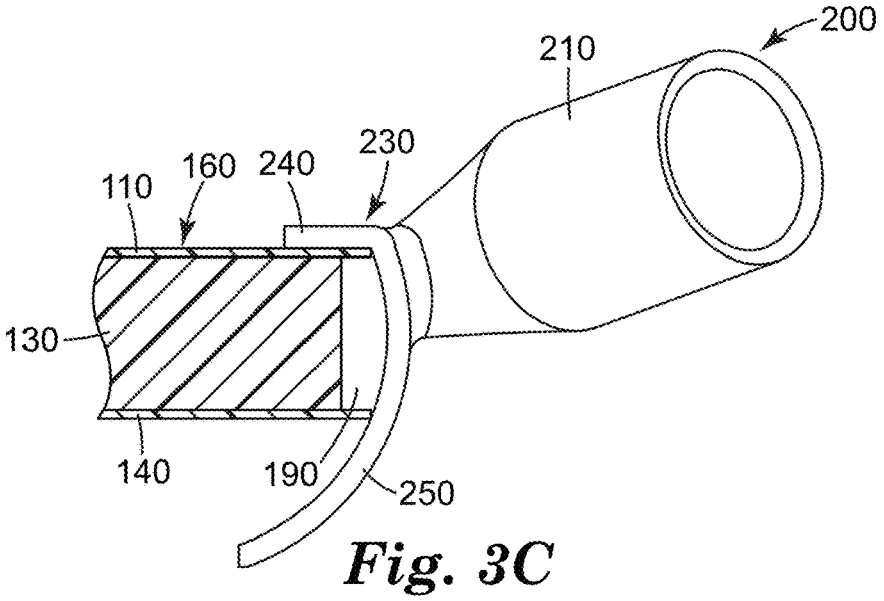

FIGS. 1A-C and FIGS. 3A-C depict certain embodiments of nozzles 200 according to the present disclosure. Arrows 205 represent the direction of movement of the nozzle in use, herein the "lateral axis." In FIGS. 2A-C, the direction of movement of the nozzle in use (the lateral axis) is orthogonal to the page, away from the viewer. The "vertical axis," as used herein, is the axis orthogonal to the panel when the nozzle is positioned next to the panel for use, as depicted in FIGS. 3A-C. FIG. 3A depicts an embodiment of a nozzle 200 according to the present disclosure positioned for use with a cut panel 160 ¼" (0.64 cm) in thickness. FIG. 3B depicts an embodiment of a nozzle 200 according to the present disclosure positioned for use with a cut panel 170 ½" (1.27 cm) in thickness. FIG. 3C depicts an embodiment of a nozzle 200 according to the present disclosure positioned for use with a cut panel 180 ⅝" (1.59 cm) in thickness. Panels 160, 170 and 180 each comprise top surface layer 110, bottom surface layer 140 and honeycomb core 130. In each of FIGS. 3A-C, honeycomb core 130 has been undercut relative to top and bottom surface layers 110, 140, leaving gap 190.

FIGS. 2A-C depict certain alternate embodiments of nozzles 200 according to the present disclosure. Arrows 205 represent the direction of movement of the nozzle in use, herein the "lateral axis." The "vertical axis," as used herein, is the axis orthogonal to the panel when the nozzle is positioned next to the panel for use.

With reference to FIGS. 1A-C, FIGS. 2A-C, and FIGS. 3A-C, nozzles 200 according to the present disclosure comprise connector portion 210 adapted to engage with a setting resin dispensing apparatus (not shown) so as to receive setting resin (not shown). Connector portion 210 may be adapted to engage any suitable setting resin dispensing apparatus. Suitable setting resin dispensing apparatus may include the output of a pump, tube, or gun, or the output of a mixing head. In some embodiments, the mixing head has an outer diameter of 10 or 13 mm, and thus connector portion 210 may have an inner diameter of 10 or 13 mm adapted for friction fit to such an apparatus. In some embodiments, the mixing head has a polygonal profile, and thus connector portion 210 may have a corresponding polygonal profile. In various embodiments, connector portion 210 may be adapted to engage a setting resin dispensing apparatus by friction fit, threaded connection, bayonet mount, or similar mechanism.

Passage 220 allows setting resin (not depicted) to enter application head 230. In some embodiments passage 220 is elongated in the lateral direction to allow for increased resin flow. In some embodiments, passage 220 passes through curved finish wall 250 of application head 230.

Connector portion 210 may engage application head 230 at any suitable angle. In some embodiments, such as depicted in FIGS. 1A-C and FIGS. 3A-C, connector portion 210 may engage application head 230 at approximately 60 degrees from vertical (relative to the vertical axis) and 45 degrees from lateral (relative to the lateral axis). In some embodiments, such as depicted FIGS. 2A-C, connector portion 210 may engage application head 230 at approximately 90 degrees from vertical (relative to the vertical axis) and 45 degrees from lateral (relative to the lateral axis). In some embodiments, connector portion 210 may engage application head 230 at angles of from 0 degrees to 90 degrees from vertical and from 0 degrees to 180 degrees from lateral. In some embodiments adapted to hand application, connector portion 210 engages application head 230 at angles of from 15 degrees to 75 degrees from vertical and from 15 degrees to 165 degrees from lateral. In some embodiments adapted to automated application, connector portion 210 engages application head 230 at angles of from 0 degrees to 45 degrees from vertical and from 45 degrees to 135 degrees from lateral.

Application head 230 comprises supporting wall 240. Supporting wall 240 joins with curved finish wall 250 to form an angle which, in use, rides on the outer edge of top surface layer 110 to contact, alignment and support of nozzle 200, as depicted in FIGS. 3A, 3B, and 3C. In use, supporting wall 240 may be plane parallel to and ride on top surface layer 110 to provide additional contact, alignment and support of the nozzle, as depicted in FIG. 3C. Alternately, when used with thinner panels, such as panels 160 and 170 depicted in FIGS. 3A and 3B, supporting wall 240 may angle upward from top surface layer 110. In some embodiments, "supporting wall" means a nozzle component which, when the nozzle is in use to apply resin to a panel, may be in contact with and plane parallel to a portion of the panel. In some embodiments, "supporting wall" means a nozzle component which, when the nozzle is in use to apply resin to a panel, may form an angle with curved finish wall 250 which angle rides on an outer edge of the panel. In some embodiments, application head 230 comprises a single supporting wall 240; i.e., no more than one supporting wall 240. In some embodiments, application head 230 comprises no component which, during use, makes contact with the bottom surface layer other than at the outer edge of the bottom surface layer. In some embodiments, application head 230 comprises no component other than curved finish wall 250 which, during use, makes contact with the bottom surface layer. In some embodiments, application head 230 comprises no component which, during use, makes contact with the panel other than supporting wall 240 and curved finish wall 250.

Curved finish wall 250 is curved toward the panel so as to allow the nozzle to be used with to panels of different nominal thickness, so as to allow that nozzle to adapt to variability in thickness of a single panel, and so as to provide a smoothly curved finish in the applied resin (not shown) after application. In some embodiments, the curve radius of curved finish wall 250 is constant. In some embodiments, the curve radius of curved finish wall 250 varies over the length of curved finish wall 250. In some embodiments, the curve radius of curved finish wall 250 is longer closer to the joining between curved finish wall 250 and supporting wall 240 and shorter farther from the joining between curved finish wall 250 and supporting wall 240. In some embodiments, the curve radius of curved finish wall 250 remains between 1.0 and 7.0 cm throughout the curve, in some embodiments between 1.5 and 7.0 cm, in some embodiments between 1.5 and 5.0 cm, and in some embodiments between 1.5 and 3.0 cm. In some embodiments, the curve radius of the first 1.6 cm of curved finish wall 250 (the 1.6 cm nearest to supporting wall 240) remains between 1.0 and 7.0 cm throughout the curve, in some embodiments between 1.5 and 7.0 cm, in some embodiments between 1.5 and 5.0 cm, and in some embodiments between 1.5 and 3.0 cm. As used herein, "curve radius" refers to the inner face of curved finish wall 250 and is measured for a curve existing in a plane orthogonal to the lateral axis. In some embodiments, such as depicted FIGS. 1A-C and FIGS. 3A-C, supporting wall 240 joins curved finish wall 250 along an edge at an angle of greater than 90 degrees, in some embodiments greater than 92 degrees, in some embodiments greater than 94 degrees, and in some embodiments greater than 96 degrees. In some embodiments, supporting wall 240 joins curved finish wall 250 along an edge at an angle of 92 degrees or greater and less than 120 degrees; in some embodiments greater than 94 degrees and less than 120 degrees, and in some embodiments greater than 96 degrees and less than 120 degrees. In some embodiments, curved finish wall 250 includes scoring (not shown) on the back side of curved finish wall 250 enabling the user to break off distal portions of curved finish wall 250 not necessary for use with thinner panels. The length of finish wall 250, measured along the vertical axis from the joining between finish wall 250 and supporting wall 240 to the end of finish wall 250, is greater than the width of the panel. In some embodiments, the length of finish wall 250 is at least 120% of the width of the panel, so as to aid in acquiring position on the panel; on some embodiments at least 140%, and in some embodiments at least 160%.

In some embodiments, such as depicted in FIGS. 2A-C, the trailing edge of curved finish wall 250 is curved toward the panel however the leading edge of curved finish wall 250 has a scalloped profile. The scalloped profile provides guide edges 252, 254 for panels of certain thicknesses smaller than the maximum panel thickness for which the nozzle may be used. For example, nozzle 200 depicted in FIGS. 2A-C may be used with ⅝" (1.59 cm) panels at full width and additionally incorporates guide edges 254 for use with ¼" (0.64 cm) panels and guide edges 252 for use with ½" (1.27 cm) panels. Optionally, nozzle 200 incorporating guide edges 252, 254 may additionally comprise a second support wall 242 used with maximum width panels—in this embodiment, ⅝" (1.59 cm) panels—or nozzle 200 may include only a single support wall 240. In embodiments where the leading edge of curved finish wall 250 has a scalloped profile, the profile of curved finish wall 250 varies from scalloped to smoothly curved from leading edge to trailing edge, (see, e.g., FIGS. 2A-C), so as to provide a smoothly curved finish in the applied resin (not shown) after application. In some embodiments, the curve radius of the trailing edge of finish wall 250 is constant, while in other embodiments the curve radius of the trailing edge of finish wall 250 varies over the length of the trailing edge. In some embodiments, the curve radius of the smoothly curving trailing edge of finish wall 250 remains between 1.0 and 7.0 cm throughout the curve, in some embodiments between 1.5 and 7.0 cm, in some embodiments between 1.5 and 5.0 cm, and in some embodiments between 1.5 and 3.0 cm.

The nozzles according to the present disclosure may be made of any suitable material. Suitable materials may include ceramics, metals or plastic resins, such resins potentially ABS, acrylics, polyetheramides such as ULTEM™, and optionally incorporating fibers or fillers. In some embodiments the nozzle material is optically clear or translucent so as to allow observation of the setting resin within the nozzle during preparation, use, and cleaning. The nozzles according to the present disclosure may be made by any suitable process. Suitable processes may include machining, additive processes such as 3D printing, molding processes such as injection molding. In some embodiments, the nozzles according to the present disclosure are one-piece, integrally formed articles. In some embodiments, the nozzles according to the present disclosure are integrally formed with or permanently attached to setting resin dispensing apparatus.

With reference to FIGS. 3A-C, in a method according to the present disclosure, connector portion 210 of a nozzle 200 according to the present disclosure is brought into connection with the output of a resin dispensing device (not shown). Application head 230 of nozzle 200 is brought into contact with the edge of panel 160, 170, or 180 such that supporting wall 240 is plane parallel to and rides on top surface layer 110 to provide contact, alignment and support of nozzle 200, or such that the angle formed between supporting wall 240 and finish wall 250 rides on the outer edge of top surface layer 110 to provide contact, alignment and support of nozzle 200, or both. Setting resin (not shown) is dispensed from the resin dispensing device through nozzle 200 to the edge of panel 160, 170, or 180 while the nozzle is moved in the lateral direction relative to the panel so as to apply resin to the panel edge. It is to be understood that motion of the nozzle relative to the panel may be achieved by motion of the nozzle, motion of the panel, or both. The setting resin is allowed or caused to set. Dispensing of the resin may be motivated by any suitable method, including manual and mechanical methods, and controlled by any suitable methods, including human or automated methods. Support and motion of the panel and nozzle may be accomplished by any suitable methods, including manual and mechanical methods, and controlled by any suitable methods, including human or automated methods.

Various modifications and alterations of this disclosure will become apparent to those skilled in the art without departing from the scope and principles of this disclosure, and it should be understood that this disclosure is not to be unduly limited to the illustrative embodiments set forth hereinabove.

We claim:

1. A method of applying a setting resin onto an edge of a panel having a top and bottom surface layer using a nozzle, the nozzle comprising a connector portion and an application head, wherein the connector portion is adapted to receive setting resin from a resin dispenser and deliver the setting resin to the application head, and wherein the application head comprises a supporting wall having a planar surface to contact a top surface layer of the panel, and a curved finish wall joining the supporting wall along an edge of the supporting wall at an angle greater than 92 degrees and less than 120 degrees, the method comprising:

bringing the connector portion into connection with an output of the resin dispenser;

bringing the application head of the nozzle into contact with the edge of the panel; and dispensing the setting resin through the application head onto the edge of the panel, wherein the nozzle contacts the bottom surface layer of the panel only at the outer edge of the bottom surface layer, and wherein the length of the finish wall, as measured along an axis orthogonal to the panel when the nozzle is positioned next to the panel for use, from the joining between the finish wall and the supporting wall to the distal end of the finish wall, is at least 120% of the thickness of the panel.

2. The method according to claim 1, wherein the step of bringing the application head of said nozzle into contact with the edge of the panel comprises positioning the supporting wall of the nozzle plane parallel to and in contact with the top surface layer of the panel.

3. The method according to claim 1, wherein the step of bringing the application head of said nozzle into contact with the edge of the panel comprises positioning the nozzle such that the angle formed between the supporting wall and the finish wall rides on an outer edge of a top surface layer of the panel.

4. The method of claim 1, wherein, during application of the setting resin onto the edge of the panel, the nozzle comprises no component which makes contact with the panel other than the supporting wall and the curved finish wall.

5. The method of claim 1, wherein the curved finish wall has a curve radius which remains between 1.0 and 7.0 cm throughout the length of the curved finish wall.

6. The method of claim 1, wherein the curved finish wall has a curve radius which remains between 1.0 and 7.0 cm throughout the first 1.6 cm of the curved finish wall closest to supporting wall.

7. The method of claim 6, wherein the curved finish wall has a curve radius which remains between 1.5 and 5.0 cm throughout the first 1.6 cm of the curved finish wall closest to supporting wall.

8. The method of claim 1, wherein the curved finish wall has a curve radius which is longer closer to the joining between the curved finish wall and the supporting wall and shorter farther from the joining between the curved finish wall and the supporting wall.

9. The method of claim 1, wherein the curved finish wall has a trailing edge profile which is smoothly curved and a leading edge profile which is scalloped.

10. The method of claim 1, wherein the nozzle is a one-piece, integrally formed article.

11. The method of claim 1, wherein the nozzle is optically translucent or transparent.

12. The method of claim 1, wherein the panel is a honeycomb panel.

13. The method of claim 1, wherein the setting resin is an adhesive.

14. The method of claim 1, wherein the setting resin is a low-density void filler.

* * * * *